US007370826B2

(12) United States Patent
Neveu

(10) Patent No.: US 7,370,826 B2
(45) Date of Patent: May 13, 2008

(54) TOILET PAPER DISPENSER HOUSING A ROLL, TOILET PAPER ROLL AND DISPENSER

(75) Inventor: Jean-Louis Neveu, Peymeinade (FR)

(73) Assignee: Georgia-Pacific France (FR)

( * ) Notice: Subject to any disclaimer, the term of this patent is extended or adjusted under 35 U.S.C. 154(b) by 0 days.

(21) Appl. No.: 11/572,718

(22) PCT Filed: Jul. 21, 2005

(86) PCT No.: PCT/FR2005/001882

§ 371 (c)(1),
(2), (4) Date: Jan. 26, 2007

(87) PCT Pub. No.: WO2006/024733

PCT Pub. Date: Mar. 9, 2006

(65) Prior Publication Data

US 2007/0210203 A1 Sep. 13, 2007

(30) Foreign Application Priority Data

Jul. 30, 2004 (FR) ..... 04 51748

(51) Int. Cl.
*B65H 16/02* (2006.01)

(52) U.S. Cl. ..... 242/593; 242/160.1

(58) Field of Classification Search ..... 242/593, 242/595, 597, 160.1
See application file for complete search history.

(56) References Cited

U.S. PATENT DOCUMENTS

| | | | |
|---|---|---|---|
| 3,973,695 | A | 8/1976 | Ames |
| 5,215,211 | A | 6/1993 | Eberle |
| 5,785,274 | A | 7/1998 | Johnson |
| 6,109,473 | A | 8/2000 | Neveu et al. |
| 2003/0066925 | A1 * | 4/2003 | Gerhardt et al. |

FOREIGN PATENT DOCUMENTS

| | | |
|---|---|---|
| FR | 2761252 A1 | 10/1998 |
| GB | 2308114 A | 6/1997 |

* cited by examiner

*Primary Examiner*—William A Rivera
(74) *Attorney, Agent, or Firm*—Joel T. Charlton

(57) ABSTRACT

The toilet paper dispenser as claimed for the invention including a housing (6) in which is housed a roll (3) of a paper strip (2), which has perforations transverse to strip (2) defining rectangular paper sheets (5) whose width is transverse and whose length is longitudinal. Housing (6) features a nozzle (9) with a dispensing orifice (10), by means of which the paper strip (2) is unwound. The dispenser is characterized in that the nozzle (9) and the paper roll (3) are disposed in such a way that the paper sheets (5) unwind one by one and emerge with a reduced crumpling as they exit the nozzle (9), the width of a sheet (5) is between 125 mm and 180 mm, and the ratio of the width of a sheet (5) to its length is between 0.45 and 1, preferably between 0.5 and 0.65, the paper being consumed optimally and in a pleasant manner.

16 Claims, 1 Drawing Sheet

1TOILET PAPER DISPENSER HOUSING A ROLL, TOILET PAPER ROLL AND DISPENSER

Figure 1:
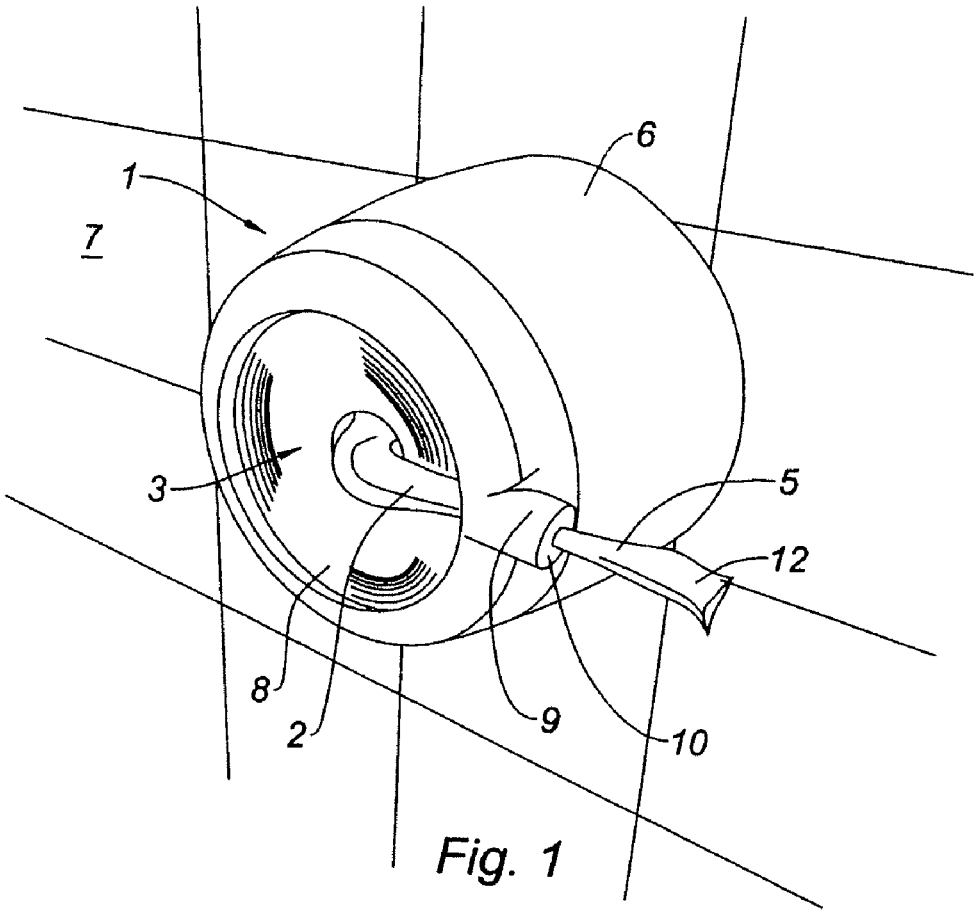

The present application claims priority to French Patent Application No. 0451748 filed on Jul. 30, 2004, which is incorporated herein in its entirety.

This invention relates to a toilet paper dispenser in which is housed a reel, the toilet paper roll, and the dispenser.

In public places, in particular, toilet paper dispensers generally comprise a housing, in which a roll of a strip of paper is mounted, which roll is unwound through a dispensing orifice. The paper strip has perforations transverse to the unwinding direction, which perforations define rectangular sheets that may be detached individually. The toilet paper is a tissue paper, with a supple and soft surface, and consists of one or several plies with a grammage usually between approximately 14 g/cm$^2$ and 30 g/cm$^2$.

The most common dispensers include an opening or window, at least the width of the toilet paper, placed in a low position on the dispenser, through which the paper is unwound. Unwinding is effected by pulling on the free end of the paper corresponding to the outside layer of the roll. In this case, it is referred to as peripheral unwinding of paper. Once the user has a certain amount of paper, the user may cut it, for example, by means of a cutting edge in the dispenser opening.

For the paper dispenser customer, and therefore for its designer, one of the major stakes in the definition of the characteristics of the dispenser and its roll is the minimizing of paper consumption. The disadvantage of the above-described device is the freedom enjoyed by the paper user to unwind a large amount of paper sheets by pulling continuously on the end of the paper strip. This user capability translates statistically into a considerable waste of paper, since the user unwinds more paper than needed.

One solution consists in imposing on the user the unwinding of the paper one sheet at a time. The prior art proposes, in the field of kitchen or drying paper, i.e., paper that, compared to toilet paper, is thicker, has larger-size sheets, and is less supple and less soft, sheet-by-sheet dispensers with central unwinding. In such dispensers, the paper is unwound from the center of the roll and extracted through the orifice of a nozzle, which nozzle is located in the axis of the roll or on the periphery of the dispenser. It generally has a truncated shape and a small exiting section in order to force the dispensing sheet by sheet. This is referred to as central unwinding of paper, in this case one sheet at a time. One example of such a dispenser is described in FR 2,761,252.

It is interesting to note at the outset that sheet-by-sheet dispensing is conditioned by the ratio of the force required for extracting the sheet through the nozzle to the force required for tearing the perforation teeth that hold together two adjacent sheets of the paper strip. The nozzle exiting orifice section has an impact on this ratio. The smaller it is, the greater the likelihood of cutting a sheet upon each extraction.

The application to toilet paper of the principle of dispensers with central unwinding of the drying paper, which forces sheet-by-sheet dispensing through the nozzle orifice, might seem self-evident. However, its implementation is constrained by a set of disadvantages which result in an impasse, particularly if the minimal consumption criterion is to be upheld.

Indeed, due to the inherent characteristics of standard toilet paper for institutional use, which commonly has sheets nearly 100 mm wide and 350 mm long, a dispenser with a nozzle having an exit orifice with a very small diameter has been proposed, so as to ensure sheet-by-sheet dispensing. The disadvantage of such a nozzle was, first of all, the difficulty of initially placing the paper into the nozzle, and secondly, the fact that upon exiting such a nozzle, the toilet paper was completely crumpled and in the shape of a string which was unpleasant for the user who had to uncrumple the exiting sheet in order to use it. In order for the paper to no longer crumple, the nozzle exiting section was increased; but then, the paper was no longer regularly dispensed one sheet at a time and the problem of overconsumption reappeared. Use has also been made of toilet paper the size of drying paper, with a nozzle having a larger exit orifice, which ensured, as in FR 2,761,252, sheet-by-sheet dispensing; but then, the sheet size was too large for the use made thereof, and the overconsumption problem arises again. Furthermore, it proved not possible to reduce sheet width.

This invention aims to propose a sheet-by-sheet toilet paper dispenser with a dispensing nozzle that delivers sheets that are little crumpled upon exiting the nozzle, making them pleasant to use, while ensuring a minimal paper consumption.

To this end, the invention relates first of all to a toilet paper dispenser including a housing that accommodates a roll of a paper strip, which has perforations transverse to the strip, thus defining rectangular paper sheets, with a transverse width and longitudinal length, said housing having a nozzle with a dispensing orifice through which the paper strip is unwound. This dispenser is characterized in that the nozzle and paper roll are disposed in such a way that the paper sheets unwind one by one and emerge less crumpled from the nozzle. The sheet width is between 125 mm and 180 mm and the ratio of the sheet width to its length is between 0.45 and 1, preferably between 0.5 and 0.65. Thus paper consumption is optimal and pleasant for the user.

The patent applicant discovered that by proposing a new proportion between the width and length of the paper sheets, it is possible not only to ensure sheet-by-sheet dispensing of the paper, but also to let the paper sheet uncrumple all by itself as it exits the nozzle upon being pulled, while maintaining a standard sheet surface area, thus avoiding an overconsumption of paper.

This invention also relates to a paper roll for the dispenser, with perforations transverse to the strip defining rectangular paper sheets, with a transverse width and a longitudinal length, the sheet width being between 125 mm and 180 mm and the ratio of the sheet width to its length between 0.45 and 1, preferably between 0.5 and 0.65.

Finally, this invention relates to a toilet paper dispenser, consisting of a housing for receiving a roll of a paper strip with a width between 125 mm and 180 mm, said housing having a nozzle with a paper dispensing orifice, the nozzle having a truncated shape, its small-diameter orifice being the dispensing orifice located outside the nozzle relative to the housing, the diameter of the nozzle dispensing orifice being between 6 and 8 mm, preferably equal to 7 mm.

Figure 2:
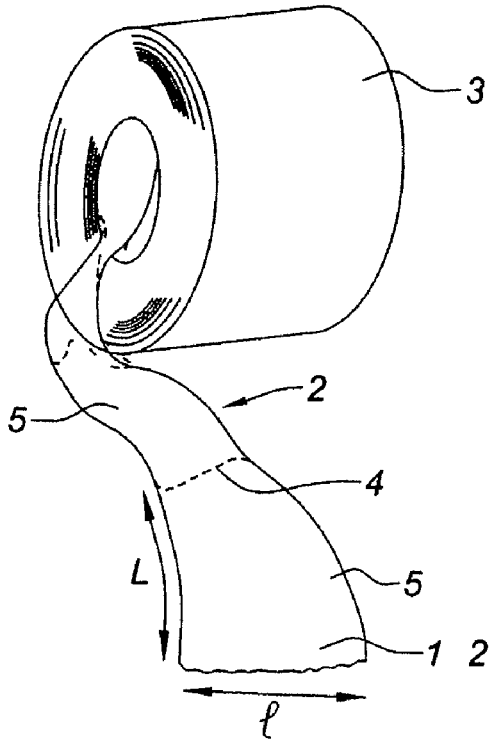

This invention will be better understood by means of the following description of the preferred embodiment of the dispenser as claimed for the invention, by reference to the attached drawing, in which:

FIG. 1 represents a perspective view of the dispenser as claimed for the invention with a sheet in the process of being unwound; and FIG. 2 represents a perspective view of the paper roll as claimed for the invention.

By reference to FIG. 1, dispenser 1 as claimed for the invention is a toilet paper dispenser. The toilet paper herein is tissue paper, comprising two plies or layers bonded to each other by any appropriate mechanical or chemical means, for example by knurling or gluing, in a manner well known to any person skilled in the art. By reference to FIG. 2, the toilet paper presents itself in the form of a strip 2 which is wound into a roll 3, which roll 3 does not include a tubular core, the paper being initially wound in such a way that one end 12 of the strip projects from the central part of roll 3 before it can be unwound therefrom. Strip 2 has perforations 4, transverse to the unwinding direction of strip 2, thus defining paper sheets 5 that can be detached individually. These paper sheets 5 are rectangular; they are defined by a transverse width "w" and a longitudinal length "L".

In the continuation of the description, by "transverse" or "longitudinal", reference is always made to "transverse" and "longitudinal" in relation to strip 2, in its unwinding direction.

Dispenser 1 includes a housing 6, cylindrical in shape, for receiving roll 3, which is also cylindrical in shape. Housing 6 is laid out in such a way so that roll 3 does not turn on its axis during unwinding. When roll 3 is inside housing 6, their axes are, as known, coexistent, if the cylinders are identical or at least parallel. Housing 6 includes means, not shown, for mounting it onto a support, in this case a wall 7 of the room in which one wishes to install dispenser 1, which mounting means are disposed in such a way that once the dispenser is hung, the axes of housing 6 and of roll 3 are perpendicular to wall 7. Housing 6 herein includes, on its side opposite wall 7, a transparent portion 8, which makes it possible to see, by transparency, roll 3 and strip 2 inside housing 6.

Housing 6 features, on its periphery, at an edge of its side opposite the wall, a dispensing nozzle 9. This nozzle 9 has here a truncated shape, its smaller-diameter orifice being the exit orifice, or dispensing orifice 10, located on the external side of nozzle 9 in relation to housing 6.

The general operation of dispenser 1 as claimed for the invention will now be explained. The free end 12 of the toilet paper strip, starting at the center of roll 3, is inserted into nozzle 9 in such a way as to project from the nozzle through its dispensing orifice 10. Because nozzle 9 herein is located at the periphery of housing 6, with its axis perpendicular to the axes of housing 6 and roll 3, there is a change of angle of strip 2 between the axis of roll 3 and the axis of nozzle 9. This change of angle is achieved naturally, without the adding of another structural component. Nevertheless, an angle modification fitting, such as a pulley or axle, could be provided.

When a user pulls on end 12 of the paper strip projecting from nozzle 9, strip 2 unwinds from its center. The diameter of the dispensing orifice 10 of nozzle 9 and sheets 5 are disposed, as set forth hereinafter with their sizes, in such a way that the dispensing occurs sheet by sheet. To this end, the force of extraction of the paper out of nozzle 9, which force depends in particular on the friction of toilet paper strip 2 onto the wall of the dispensing orifice 10 of nozzle 9, must be greater than the force of the tearing of the perforation teeth that hold together two adjacent sheets 5 of strip 2, which depends in particular on the strength of the toilet paper and on the perforation rate of precuts 4, which is equal to the ratio of the sum of the transverse dimensions of the sheet perforation teeth to the width of strip 2. Thus, as the user unwinds strip 2, when the next perforation 4 comes out of nozzle 9, due to the above-described force ratio, sheet 5 being pulled by the user separates from the next sheet before this latter sheet fully exits nozzle 9. Thus we truly have a sheet-by-sheet delivery. The next sheet then projects from nozzle 9 and can in turn be unwound.

This ratio of the extraction force to the tearing force must in particular be sufficient to offset the angle variations between the perforations 4 and the axis of the dispensing orifice 10 of nozzle 9, which angle impacts on the tearing of the paper, and which variations are related to the fact that the paper does not always present itself at the same angle, in particular depending on the amount of paper that has already been unwound.

Seeking to obtain with certainty this sheet-by-sheet delivery, while ensuring that the unwound sheet 5 uncrumples by itself while exiting nozzle 9, this patent applicant discovered that it was possible to propose a new format for sheets 5, in such a way that the ratio "w/L" of their width (w) to their length (L) is between 0.45 and 1, for sheets whose width is between 125 mm and 180 mm.

In particular, by contrast with the prior art, this patent applicant had wished to increase the width "w" of sheets as well as the diameter of the dispensing orifice 10 of nozzle 9, in order to facilitate the unfolding of sheets 5 as they exit nozzle 9. The applicant had also considered that sheets 5 must retain a surface area equivalent to that of the sheets in the prior art, in order not to trigger any overconsumption of paper while still ensuring the drying function of sheets 5. In general, in the dispensers installed in public places, the sheets under the prior art are 98 mm wide and 350 mm long, thus presenting a surface area of 34300 $mm^2$. The applicant thus modified the proportions between width "w" and length "L" of the sheets, while retaining an equivalent (plus or minus 1 percent) sheet surface, which remains to be defined by the manufacturer of dispenser 1.

The applicant has conducted a series of tests, including in particular tests for computation of the percentage of success of sheet-by-sheet unwinding, tests on user behavior, all such tests being well known to any person skilled in the art. The applicant derived from said tests a range of preferred parameters, in addition to the w/L ratio, which parameters make it possible to even better fulfill the whole set of objectives of the invention, namely sheet-by-sheet unwinding of the paper, uncrumpling of the sheets as they exit the nozzle, and reduced paper consumption compared with the dispensers under the prior art. These additional preferred parameters are presented below.

The Table below presents some of the data from a series of tests that were performed, both on a roll under the prior art, and on a series of rolls 3 as claimed for the invention, which rolls 3 have sheets with a "w/L" ratio between 0.45 and 1. The tests were conducted with two-ply, 16 $g/m^2$ grammage paper for each ply, with a nozzle 9 whose dispensing orifice 10 has a 7 mm diameter.

| | Prior art | | | | Invention | | | |
|---|---|---|---|---|---|---|---|---|
| Width w (mm) | 98 | 130 | 136 | 140 | 145 | 150 | 155 | 180 |
| Length L (mm) | 350 | 264 | 254 | 245 | 235 | 228 | 221 | 190 |
| Ratio w/L | 0.28 | 0.49 | 0.54 | 0.57 | 0.62 | 0.66 | 0.70 | 0.95 |
| Surface w * L ($mm^2$) | 34300 | 34320 | 34544 | 34300 | 34075 | 34200 | 34255 | 34200 |
| Roll length (m) | 200 | 200 | 200 | 200 | 200 | 200 | 200 | 200 |
| Number of roll sheets | 571 | 758 | 787 | 816 | 851 | 877 | 905 | 1053 |
| Average number of sheets per user | 6 | 5 | 5 | 5 | 5 | 5 | 5 | 5 |
| Number of users per sheet | 95 | 152 | 157 | 163 | 170 | 175 | 181 | 210 |
| Increase in autonomy | | 59.09% | 65.35% | 71.43% | 78.72% | 84.21% | 90.05% | 121.68% |

Another advantage of the invention appears upon reading the above Table: due to the increased width of strip 2, for approximately the same unit surface area of sheet 5, the length "L" of sheets 5 must be decreased. Thus, for a roll of equal length (by length of roll 3, the length of strip 2 comprising said roll is meant), herein for example equal to 200 m, the number of sheets 5 of roll 3 is increased, and consequently so is the autonomy of dispenser 1. This makes it possible to decrease the number of maintenance personnel interventions for filling the empty dispensers and thus realize savings.

In addition, the applicant finds that with the new format for sheets 5, the users use less sheets 5 (see "average number of sheets per user" in the above Table), hence a lesser sheet surface. The per-user toilet paper consumption is thus decreased and the autonomy of dispenser 1 conversely increased.

The embodiment in FIG. 1, with the axis of housing 6 and roll 3 both perpendicular to wall 7, in conjunction with the sizing of the toilet paper as claimed for the invention, is advantageous because the overall size is decreased in the direction perpendicular to washroom wall 7. Indeed, this overall size is here directly dependent on the paper sheet 5 width "w" which is, as will be seen, set between 125 and 180 mm. This overall size is acceptable in a washroom and is thus bounded. It is thus possible to increase to one's liking the diameter of housing 6 so that it can accommodate a roll 3 with a larger diameter, that is to say, comprising a larger number of sheets 5. This increase in the number of sheets 5 only affects the directions parallel to the washroom wall 7, in the geometric planes bounded by the toilet paper width which is between 125 and 180 mm. Thus we can, without any cumbersome increase in the overall size, increase yet again the autonomy of dispenser 1.

Further to these various tests and other tests, as well as upon taking into account numerous parameters such as overall size, ease of paper extraction while ensuring its sheet-by-sheet dispensing, etc., the applicant defined the following parameter ranges (with the additional preferred parameters set forth hereinabove), for an optimal operation of dispenser 1 as claimed for the invention:

- toilet paper comprising one or several plies, preferably comprising two plies, in tissue paper, each ply having a grammage between 14 and 30 $g/m^2$, preferably between 15 and 20 $g/m^2$;
- width "w" between 125 and 180 mm, preferably between 135 and 150 mm;
- ratio "w/L" between 0.45 and 1, preferably between 0.5 and 0.65;
- diameter of the dispensing orifice 10 of nozzle 9 between 6 and 8 mm, preferably equal to 7 mm;
- rate of perforation of precuts 4 of strip 2 between 12 and 30%, preferably between 14 and 20%;
- ratio of the force of extraction of toilet paper from the nozzle to the force of tearing of the perforation teeth of two adjacent sheets 5 of strip 2: this ratio is strictly higher than 1, preferably between 1.1 and 2.

Thanks to the invention, a dispenser 1 is obtained comprising a housing 6 and a nozzle 9, that thus fulfills a roll 3 protection function for hygienic and theft deterrence purposes. Delivery is one sheet at a time, while replacement and installation of roll 3 are easy to carry out, in particular with a dispensing orifice 10 of a nozzle 9 sufficiently large to reduce sheet crumpling. The format of sheets 5, in conjunction with the sheet-by-sheet dispensing, results in a decrease of paper consumption by users. In the case of a mounting of housing 6 with its axis perpendicular to support 7, the overall size is bounded by the width of strip 2 and permits an increase in the length of strip 2, thus increasing the autonomy of roll 3, all the more so since said roll has a larger number of sheets 5 per unit of length.

The applicant conducted tests to size the paper roll 3 and the dispenser 1 under a preferred embodiment of the invention, herein in connection with a central unwinding with nozzle 9 in the axis of roll 3. The results of said tests are reported in the Table hereinbelow. For a two-ply paper with 16 $g/m^2$ grammage for each ply, with a nozzle 9 whose dispensing orifice 10 has a 7 mm diameter, the applicant conducted tests for three different perforation rates, namely 14%, 16% and 20%, each for two sheet formats (245×136 $mm^2$ and 235×146 $mm^2$) and within the parameter ranges of the invention. The applicant then measured, by means of a dynamometer, the extraction force of sheets 5 and their tearing force, in centi-newton (cN), the standard deviation being indicated in the Table, first at the beginning of the roll, when sheets 5 are close to the cone in connection with a central unwinding with nozzle 9 in the axis, then after 100 sheets were unwound, after 200 sheets, and after 300 sheets. The average ratios between the extraction force and tearing force are fully within the required ranges, and very good results were obtained as regards the sheet-by-sheet unwinding.

| | | Perforation rate | | | | | |
|---|---|---|---|---|---|---|---|
| | | 14% | | 16% | | 20% | |
| | | Sheet dimensions (w × L) | | | | | |
| | | 254 × 136 | 235 × 146 | 254 × 136 | 235 × 146 | 254 × 136 | 235 × 146 |
| Extraction force (cN) | Near the cone | 645 +/− 75 | 830 +/− 140 | 615 +/− 100 | 835 +/− 70 | 750 +/− 110 | 990 +/− 140 |
| | After 100 sheets | 520 +/− 40 | 675 +/− 70 | 575 +/− 90 | 710 +/− 70 | 565 +/− 70 | 770 +/− 230 |
| | After 200 sheets | 540 +/− 45 | 650 +/− 75 | 555 +/− 55 | 650 +/− 90 | 520 +/− 40 | 620 +/− 90 |
| | After 300 sheets | 540 +/− 50 | 645 +/− 80 | 550 +/− 50 | 465 +/− 75 | 500 +/− 50 | 645 +/− 35 |
| Tearing force (cN) | Near the cone | 355 +/− 80 | 330 +/− 60 | 370 +/− 55 | 370 +/− 85 | 490 +/− 65 | 535 +/− 100 |
| | After 100 sheets | 330 +/− 70 | 370 +/− 75 | 380 +/− 75 | 360 +/− 170 | 475 +/− 75 | 620 +/− 80 |
| | After 200 sheets | 310 +/− 55 | 345 +/− 90 | 345 +/− 80 | 400 +/− 60 | 520 +/− 95 | 555 +/− 90 |
| | After 300 sheets | 300 +/− 40 | | 315 +/− 95 | 280 +/− 95 | 545 +/− 60 | 585 +/− 195 |
| Ratio of extraction force to tearing force | | 1.7 | 2.0 | 1.6 | 1.9 | 1.2 | 1.3 |
| Rate of success of sheet-by-sheet delivery | | 100% | 100% | 100% | 100% | 99% | 99% |

The invention was described above in connection with a central unwinding, but it is self-evident that it also applies to a lateral unwinding. Furthermore, in the case of the central unwinding, the nozzle 9 can, as described herein, extend on the periphery of housing 6, but also in the axis of roll 3, which could in this case be horizontal or vertical, regardless of the embodiment selected. Furthermore, a supporting spindle for roll 3 could be provided in housing 6. Finally, nozzle 9 does not necessarily have to be truncated. Any calibrated dispensing orifice could be used.

The invention claimed is:

1. A toilet paper dispenser comprising:

a housing in which is housed a roll of a paper strip that has perforations transverse to the paper strip defining rectangular paper sheets whose width w is transverse and whose length L is longitudinal, wherein the housing comprises a nozzle having a dispensing orifice through which the paper strip is unwound, wherein the nozzle and the roll are disposed in such a way that the paper sheets unwind one by one and emerge with reduced crumpling from an exit orifice in the nozzle; and wherein the width w of a sheet is between 125 millimeters and 180 millimeters and the sheet has a ratio of the width w to the length L of between 0.45 and 1.

2. The dispenser as claimed in claim 1, wherein the ratio of the width w to the length L is between 0.5 and 0.65.

3. The dispenser as claimed in claim 1, wherein unwinding is effected from a center of the roll.

4. The dispenser as claimed in claim 1, wherein the nozzle has a truncated shape and the exit orifice is located outside the nozzle relative to the housing.

5. The dispenser as claimed in claim 1, wherein the housing is mounted onto a support and an axis of the roll is perpendicular to the support.

6. The dispenser as claimed in claim 1, wherein the width w of the sheets is between 135 millimeters and 150 millimeters.

7. The dispenser as claimed in claim 6, wherein the exit orifice of the nozzle has a diameter of between 6 millimeters and 8 millimeters.

8. The dispenser as claimed in claim 6, wherein the paper strip has a perforation rate of between 12% and 30%.

9. The dispenser as claimed in claim 6, wherein force of extraction of the paper strip outside the nozzle is present in a ratio to force of tear of perforation teeth holding together two adjacent sheets of the paper strip, wherein the ratio is greater than 1.

10. The dispenser as claimed in claim 9, wherein the ratio is between 1.1 and 2.

11. The dispenser as claimed in claim 6, wherein the paper sheets are a one- or two-ply tissue paper, each ply having a grammage between 14 g/m$^2$ and 30 g/m$^2$.

12. A toilet paper roll comprising:

perforations transverse to a paper strip defining rectangular paper sheets, whose width w is transverse and whose length L is longitudinal, the width w of a sheet being between 125 millimeters and 180 millimeters, and a ratio of the width w of a sheet to length L of the sheet is between 0.45 and 1.

13. The toilet paper roll as claimed in claim 12, wherein the width w is between 135 millimeters and 150 millimeters.

14. The toilet paper roll as claimed in claim 12, wherein the perforations are present in a rate of precuts of the paper strip of between 12% and 30%.

15. The toilet paper roll as claimed in claim 12, wherein the roll is of a two-ply tissue paper, each ply having a grammage between 14 g/m$^2$ and 30 g/m$^2$.

16. A toilet paper dispenser comprising:

a housing disposed in such a way as to receive a roll of a paper strip having a width of between 125 millimeters and 180 millimeters, wherein the housing comprises a nozzle with a dispensing orifice for the paper strip, the nozzle having a truncated shape and the dispensing orifice being located outside the nozzle relative to the housing, the dispensing orifice of the nozzle having a diameter of between 6 millimeters and 8 millimeters.

* * * * *